US006276666B1

(12) United States Patent
Roberts

(10) Patent No.: US 6,276,666 B1
(45) Date of Patent: Aug. 21, 2001

(54) APPARATUS AND METHOD FOR MOVING A LOAD

(75) Inventor: William David Roberts, Silverdale, WA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 09/543,603

(22) Filed: Apr. 5, 2000

(51) Int. Cl.[7] ..... B66D 3/04

(52) U.S. Cl. ..... 254/413; 254/389; 294/67.2; 294/67.31

(58) Field of Search ..... 254/199, 242, 254/334, 335, 336, 389, 390, 391, 394, 408, 266; 294/67.2, 67.22, 67.31

(56) References Cited

U.S. PATENT DOCUMENTS

| | | | | |
|---|---|---|---|---|
| 164,432 | * | 6/1875 | Duhamel | 254/334 |
| 626,102 | * | 5/1899 | Scott | 254/266 |
| 665,757 | * | 1/1901 | Rynearson | 254/336 |
| 694,866 | * | 3/1902 | Kascewitz et al. | 254/336 |
| 888,695 | * | 5/1908 | Collin | 254/334 |
| 1,024,665 | * | 4/1912 | Barlow | 254/266 |
| 2,604,302 | | 7/1952 | Francis | 254/139.1 |
| 3,361,411 | | 1/1968 | Reigh | 254/147 |
| 3,601,366 | | 8/1971 | Webster | 254/147 |
| 3,801,069 | | 4/1974 | McCarstle | 254/143 |
| 3,918,592 | * | 11/1975 | Paul | 254/390 |
| 4,364,545 | * | 12/1982 | Kobylinski | 254/334 |
| 5,090,667 | | 2/1992 | Harrell | 254/326 |
| 5,588,907 | | 12/1996 | DePietro | 452/187 |
| 5,816,564 | | 10/1998 | Winter | 254/266 |
| 5,904,463 | | 5/1999 | Christensen | 414/462 |
| 6,050,548 | * | 4/2000 | Leger | 254/335 |
| 6,112,607 | * | 9/2000 | Pauls | 254/335 |

FOREIGN PATENT DOCUMENTS

| | | | | |
|---|---|---|---|---|
| 2222996 | * | 3/1990 | (GB) | 254/199 |
| 41348 | * | 3/1977 | (JP) | 254/199 |
| 102239 | * | 8/1962 | (NL) | 254/336 |

* cited by examiner

*Primary Examiner*—Emmanuel M. Marcelo
(74) *Attorney, Agent, or Firm*—Sidley Austin Brown & Wood; Stephen S. Sadacca

(57) ABSTRACT

An apparatus for moving a load has a boom with a lower end and an upper end and a base having a front end and a rear end. The front end of the base is pivotably connected to the lower end of the boom along a pivot axis, wherein a lower surface of the base rests on a support surface while a load is being moved. A first restricting mechanism restricts relative movement between the boom and the base about the pivot axis in a first direction and a second restricting mechanism restricts the relative movement between the boom and the base about the pivot axis in a second direction. A pulley mechanism is disposed proximal to the upper end of the boom. A rope having a load end is provided, wherein the load is attachable to the load end of the rope. The rope is threaded through the pulley mechanism. An attached load is lifted when the rope travels in a lifting direction through the pulley mechanism and the attached load is lowered when the rope moves in a lowering direction, which is opposite of the lifting direction, through the pulley mechanism.

14 Claims, 7 Drawing Sheets

APPARATUS AND METHOD FOR MOVING A LOAD

FIELD OF THE INVENTION

The present invention relates to an apparatus and method for moving a load and, in one aspect, an apparatus and method for raising a load onto an elevated surface and lowering a load from an elevated surface.

BACKGROUND OF THE INVENTION

In many situations, items must be lifted onto an elevated surface or lowered from an elevated surface. Often, equipment must be lifted onto or lowered from rooftops or elevated platforms. Unless a hoist is provided on the elevated surface, the equipment is typically carried up a ladder by hand or, if the equipment is sufficiently heavy, is lifted onto the elevated surface by a crane.

Hand carrying equipment via a ladder can be dangerous, especially if the equipment is cumbersome or heavy. The use of a crane to move equipment onto or from an elevated surface is not typically dangerous but can be quite expensive. Further, it is difficult in some circumstances to position a crane within close confines so that it can reach the elevated surface.

Thus, a need exists for a lifting device which can be inexpensively and readily positioned to lift items onto and lower items from elevated surfaces.

BRIEF SUMMARY OF THE INVENTION

The present invention is a new and advantageous apparatus and method for raising a load onto an elevated surface and for lowering a load from an elevated surface.

The present invention includes a boom having a lower end and an upper end and a base having a front end and a rear end. The front end of the base is pivotably connected to the lower end of the boom along a pivot axis, wherein a lower surface of the base rests on a support surface while a load is being moved. A first restricting mechanism restricts relative movement between the boom and the base about the pivot axis in a first direction and a second restricting mechanism restricts the relative movement between the boom and the base about the pivot axis in a second direction. A pulley mechanism is disposed proximal to the upper end of the boom. A rope having a load end is provided, wherein the load is attachable to the load end of the rope. The rope is threaded through the pulley mechanism. An attached load is lifted when the rope travels in a lifting direction through the pulley mechanism and the attached load is lowered when the rope moves in a lowering direction, which is opposite of the lifting direction, through the pulley mechanism.

BRIEF DESCRIPTION OF THE DRAWINGS

Other advantages and features of the invention will become more apparent with reference to the following detailed description of the invention in connection with the accompanying drawings, in which.

DETAILED DESCRIPTION OF THE INVENTION

Figure 1:
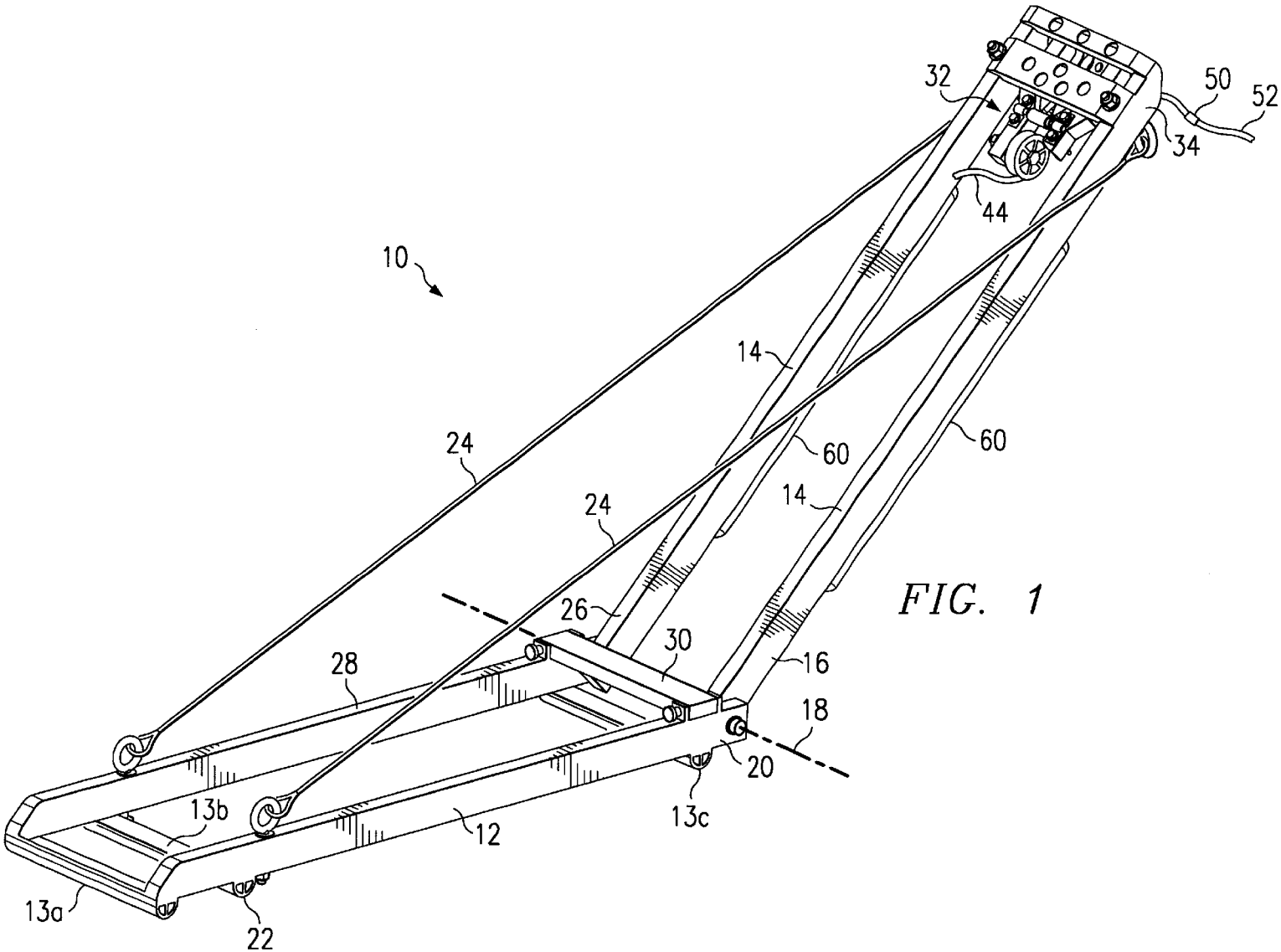
FIG. 1 is a perspective view of the apparatus of the present invention.

Referring to the drawings and FIG. 1 in particular, shown therein is a lift 10, which is an apparatus for moving a load, having a base 12 and a boom 14. The lower end 16 of the boom 14 is pivotably attached along a pivot axis 18 to a front end 20 of the base 12. A lower surface 22 of the base 12 rests on a support surface, such as the elevated surface, while the load is being moved. The base 12 comprises cross-members 13*a–c* which have rounded lower surfaces to facilitate positioning of the lift 10 to a desired location on the elevated surface.

Two support cables 24 are connected between the boom 14 and the base 12 preferably at locations which are away from the pivot axis 18. The support cables 24 have lengths which restrict relative movement between the boom 14 and the base 12 about the pivot axis 18 in a first direction. In other words, when at least one of the support cables 24 becomes taut, the boom 14 is prevented from rotating about the pivot axis 18 with respect to the base 12 to increase an angle between the upper surface 26 of the boom 14 and the upper surface 28 of the base 12. While this embodiment of the present invention is disclosed as having two support cables 24, the scope of the present invention includes embodiments having only one support cable 24 or more than two support cables 24. Further, while support cables 24 are provided in this embodiment of the invention as features which restrict relative movement between the boom 14 and the base 12 about the pivot axis 18 in the first direction, other features which are capable of restricting relative movement between the boom 14 and the base 12 about the pivot axis 18 in the first direction are included in the scope of the invention.

A stop block 30 is removably attached to the upper surface 28 of the base 12 preferably near the pivot axis 18 for restricting relative movement between the boom 14 and the base 12 about the pivot axis 18 in a second direction when upper surface 26 of the boom 14 contacts the stop block 30. Thus, as the boom 14 is prevented from rotating about the pivot axis 18 with respect to the base 12 to decrease an angle between the upper surface 26 of the boom 14 and the upper surface 28 of the base 12. While this embodiment of the present invention is disclosed as having one stop block 30, the scope of the present invention includes embodiments having, for example, two stop blocks, one being located on each side of the base 12. Further, while the stop block 30 is provided in this embodiment of the invention as a feature which restricts relative movement between the boom 14 and the base 12 about the pivot axis 18 in a second direction, other features which are capable of restricting relative movement between the boom 14 and the base 12 about the pivot axis 18 in a first direction are included in the scope of the invention.

The combination of the support cables 24 and the stop block 30 restricts the relative movement between the boom 14 and the base 12 about the pivot axis 18 to range of about 30 degrees to about 180 degrees and, preferably, to a range of about 45 degrees to about 160 degrees. While these ranges of relative movement are preferable for this embodiment of the present invention, any range which allows the proper lifting and lowering of loads is included in the scope of the invention.

Figure 2:
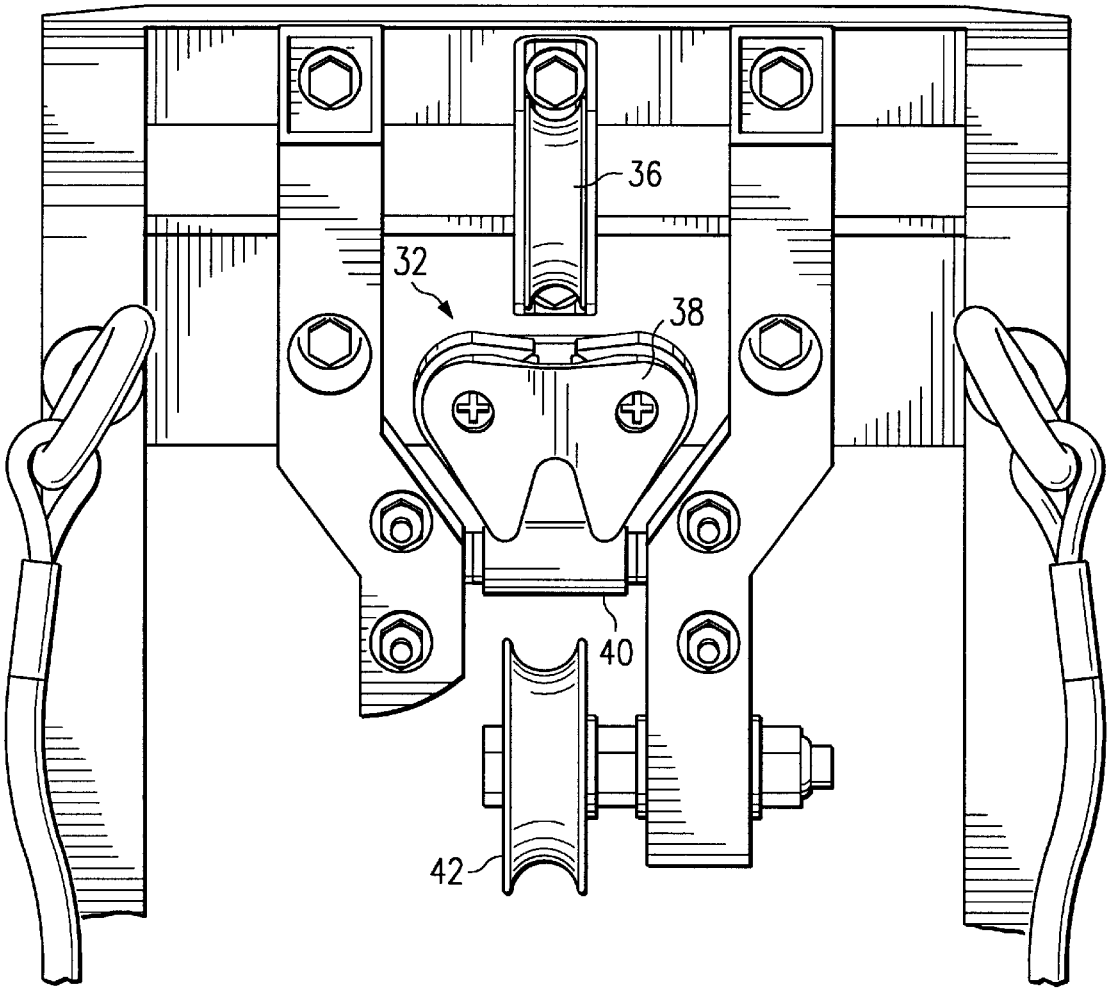
FIG. 2 is an orthographic view of the pulley mechanism of the apparatus of the present invention.
Figure 3:
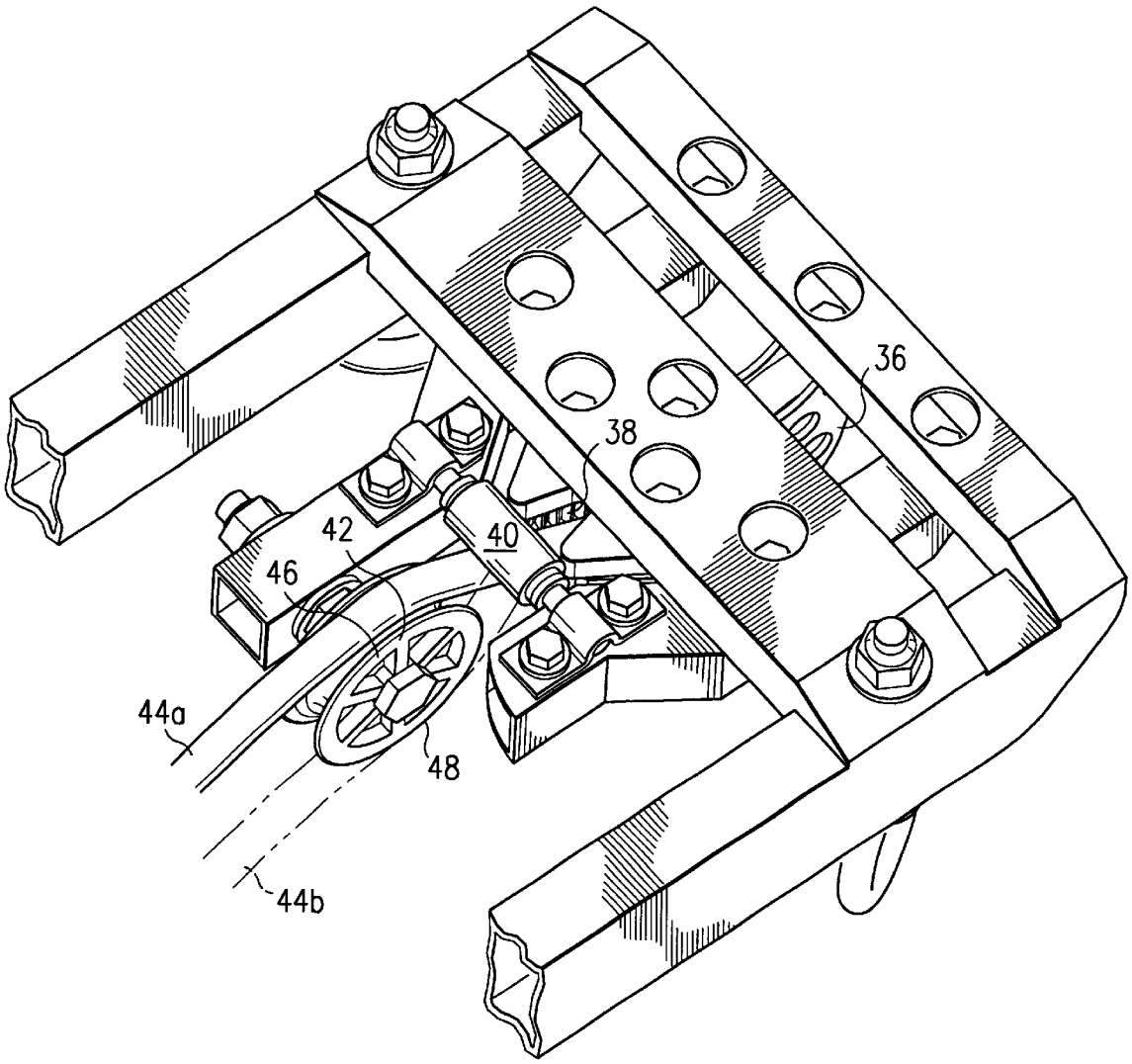
FIG. 3 is a perspective view of the pulley mechanism of the apparatus of the present invention.

A pulley mechanism 32 is located near the upper end of the boom 14. Referring now to FIGS. 2 and 3, the pulley mechanism 32 comprises a main pulley 36, a rope lock 38, a roller 40, and a release pulley 42. These elements are aligned such that a rope 44 can be threaded therethrough. The main pulley 36 guides and pivots the rope 44 so that a load can be lifted or lowered. The rope lock 38, when engaged, prevents the rope 44 from moving through the pulley mechanism 32 in a lowering direction. The roller 40 guides the rope 44 between the rope lock 38 and the release pulley 42. The release pulley 42 is positioned such that, when the rope 44 is threaded across the top side 46 of the release pulley 42, the rope 44 (shown in FIG. 3 as 44*a*) is engageable in the rope lock 38. However, when the rope 44 is threaded across the bottom side 48 of the release pulley 42, the rope 44 (shown in FIG. 3 as 44*b*) is shifted away from the rope lock 38 and is, therefore, not engageable in the rope lock 38.

Figure 4:
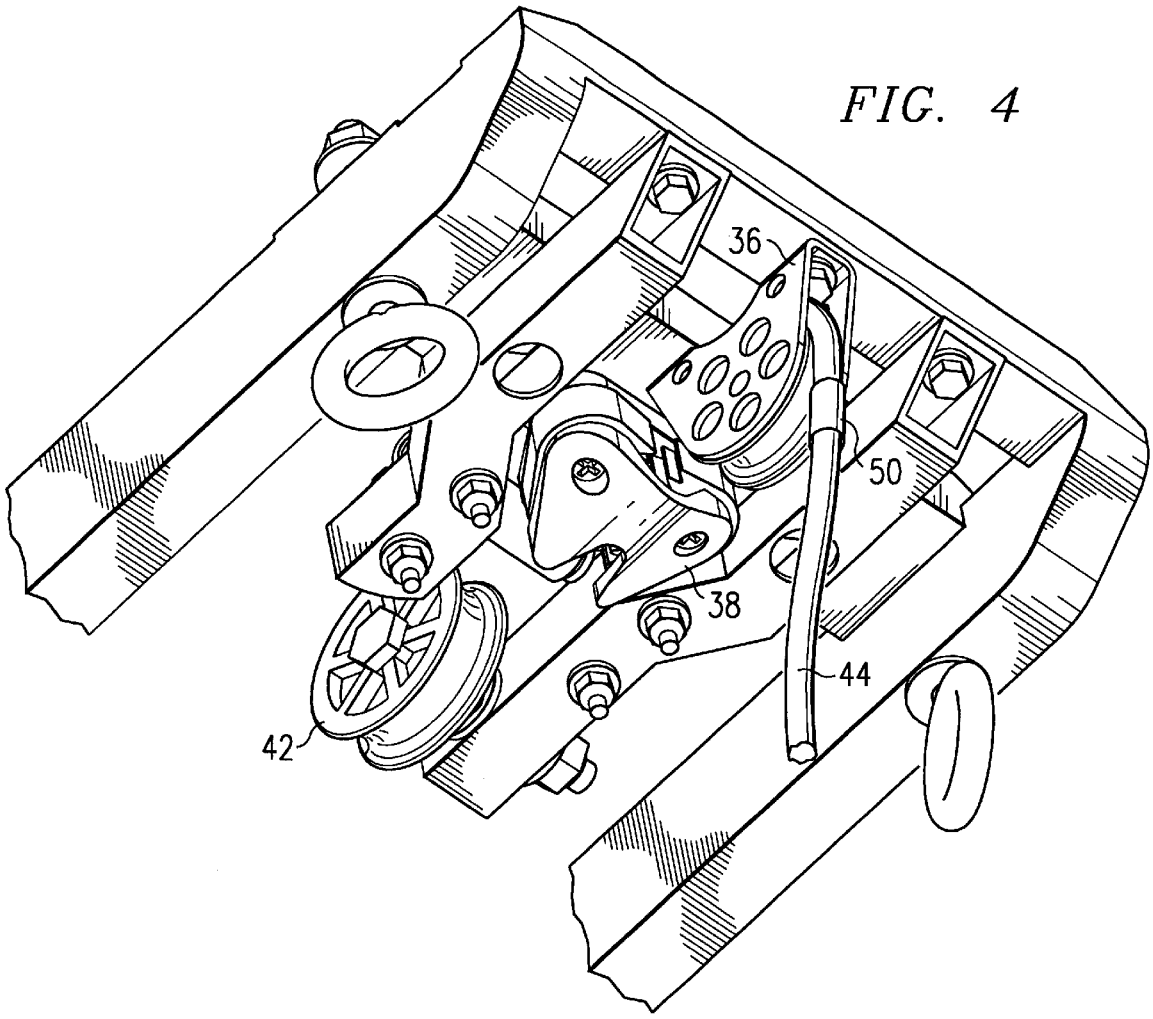
FIG. 4 is another perspective view of the pulley mechanism of the apparatus of the present invention.

Referring now to FIG. 4, the rope 44 has a stopper 50 at a predetermined distance from the load end 52 of the rope 44 for contacting the main pulley 36 when the rope 44 is moved through the pulley mechanism 32 in the lifting direction. When the rope 44 is pulled further in the lifting direction after the stopper 50 contacts the main pulley 36, or any suitable portion of the lift 10, the boom 14 moves relative to the base 12 about the pivot axis 18 in the second direction if the boom 14 is not in contact with the stop block 30. Thus, in this situation, the boom 14 moves relative to the base 12 about the pivot axis 18 to decrease the angle between the upper surface 26 of the boom 14 and the upper surface 28 of the base 12 until the boom 14 makes contact with the stop block 30. The stopper 50 can be a non-sliding knot tied in the rope 44 or can be another type of stopper element which is attached to the rope 44 at the desired location. In this embodiment of the present invention, it is desirable that the stopper 50 be located approximately 15 cm to 46 cm (6 in to 8 in) along the rope 44 from the attached load.

Referring again to FIG. 1, bumper strips 60 are provided to support the load as the boom 14 is pivoted either away from the edge of the elevated surface or toward the edge of the elevated surface. In other words, when the boom 14 is extended over the base 12 rather than over the edge of the elevated surface, the load rests on the bumper strips 60. The bumper strips 60 are made of a rubber-like material so that the load, when in contact therewith, is inhibited from moving laterally or sliding with respect to the boom 14.

Figure 5:
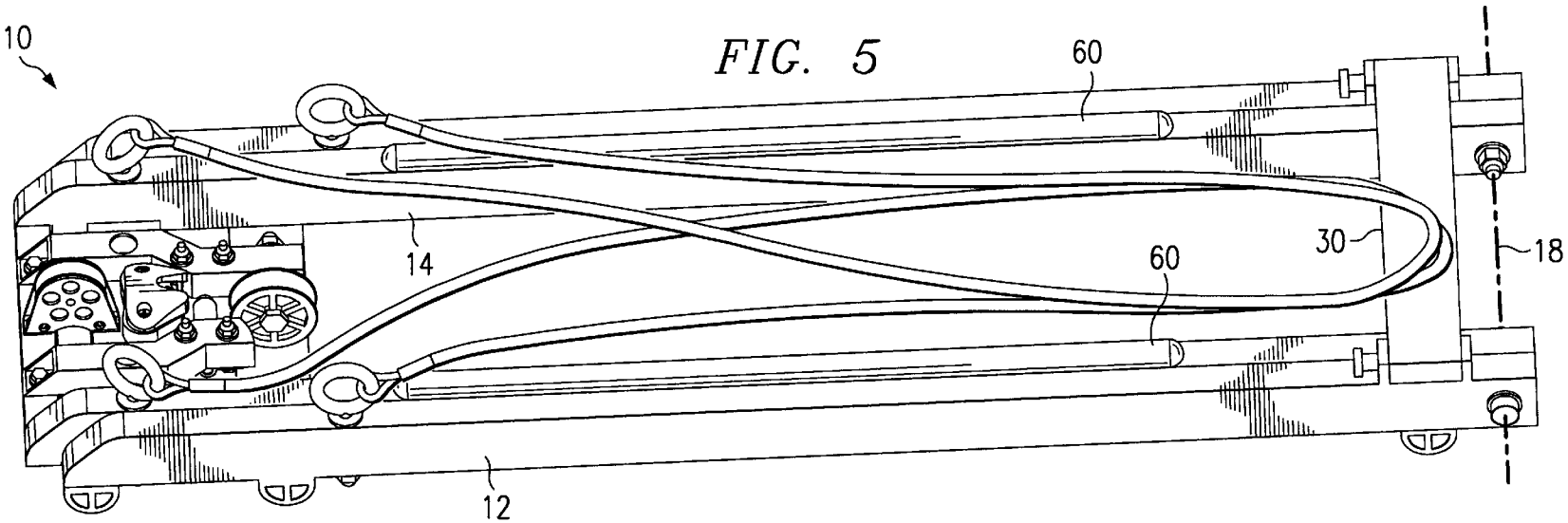
FIG. 5 is perspective view of the apparatus of the present invention in a folded configuration.

Referring now to FIG. 5, the lift 10 is shown therein in a folded configuration, which is an advantageous arrangement for transporting the lift 10. With the stop block 30 removed from the base 12, the boom 14 can be rotated relative to the base 12 about the pivot axis 18 such that the boom 14 nests within the confines of the base 12. By attaching the stop block 30 after folding up the lift 10, the boom 14 is prevented from rotating about the pivot axis 18 relative to the base 12. Thus, the lift 10 can easily be carried.

The boom 14 and the base 12 of the above disclosed embodiment of the lift 10 is made principally of welded aluminum rectangular tubing; however, any material or method of manufacturing which is capable of providing a boom 14 and a base 12 that can be used as described herein is considered to be within the scope of the invention.

Figure 6:
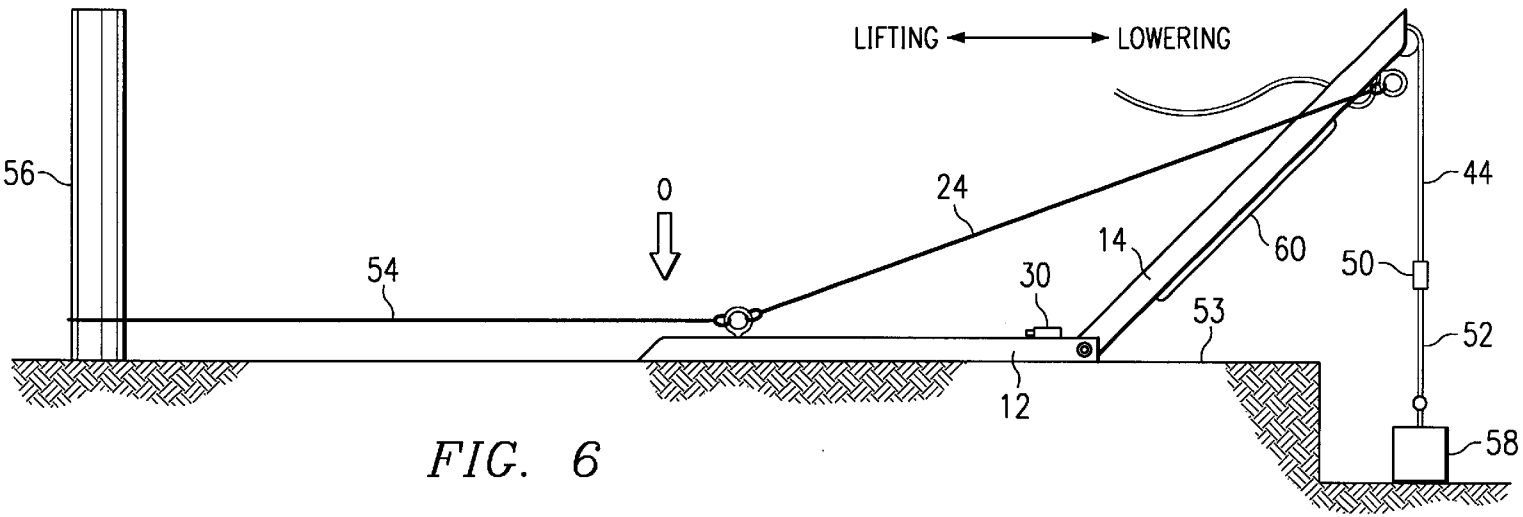
FIGS. 6–10 are schematic views of the apparatus the present invention in use.

Schematic views of the lift 10 of the present invention are presented in FIGS. 6–10 which illustrate the lifting of a load onto an elevated surface and the lowering of a load from an elevated surface 53. Referring now specifically to FIG. 6, a safety rope 54 is attached to the base 12 of the lift 10 and also attached to a column 56 or other stationary member which is capable of safely restraining the lift 10. The lift 10 is positioned so that the safety rope 54 is tensioned between the base 12 and the column 56. The boom 14 is pivoted with respect to the base 12 about the pivot axis 18 until the support cables 24 are substantially taut. A rope 44 is threaded through a pulley mechanism 32 so that the rope 44 is not engaged with the rope lock 38 (see FIG. 3) and the rope 44 is attached to a load 58. A stopper 50 is located approximately 15 cm to 46 cm (6 in to 8 in) along the rope 44 from the attached load 58. The base 12 is stabilized against the elevated surface 53 by the operator standing on the base, as indicated by the arrow 0. If the operator does not stand on the base, the safety rope 54 is provided to prevent the lift from being pulled over the edge of the elevated surface 53.

Figure 7:
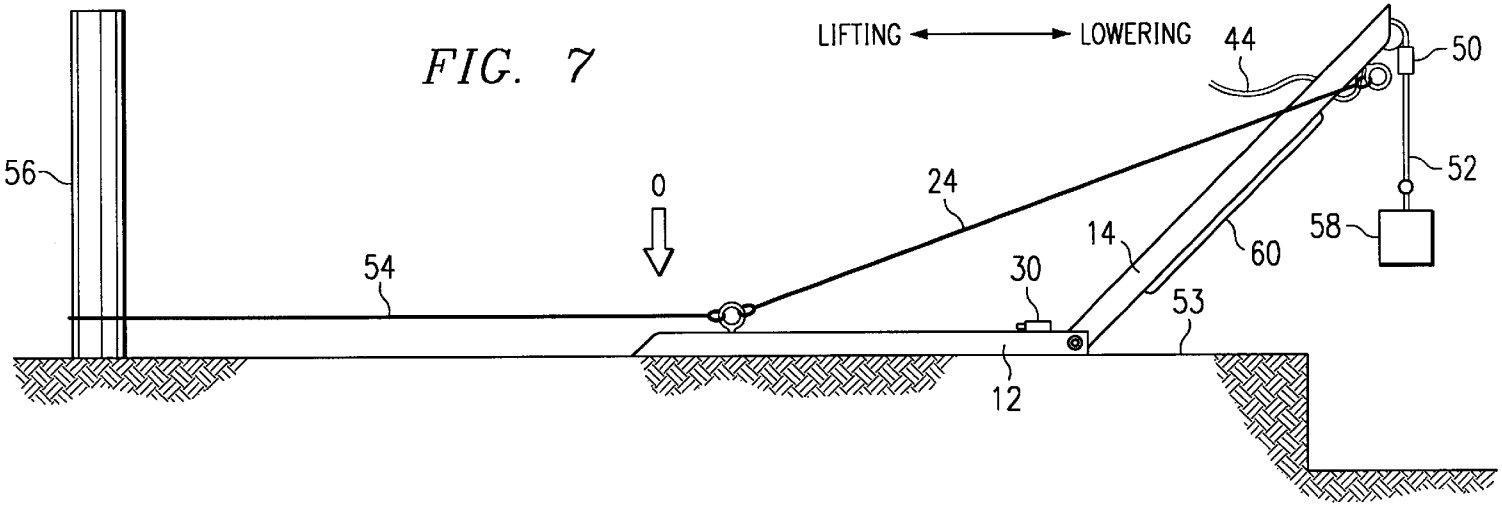
Figure 8:
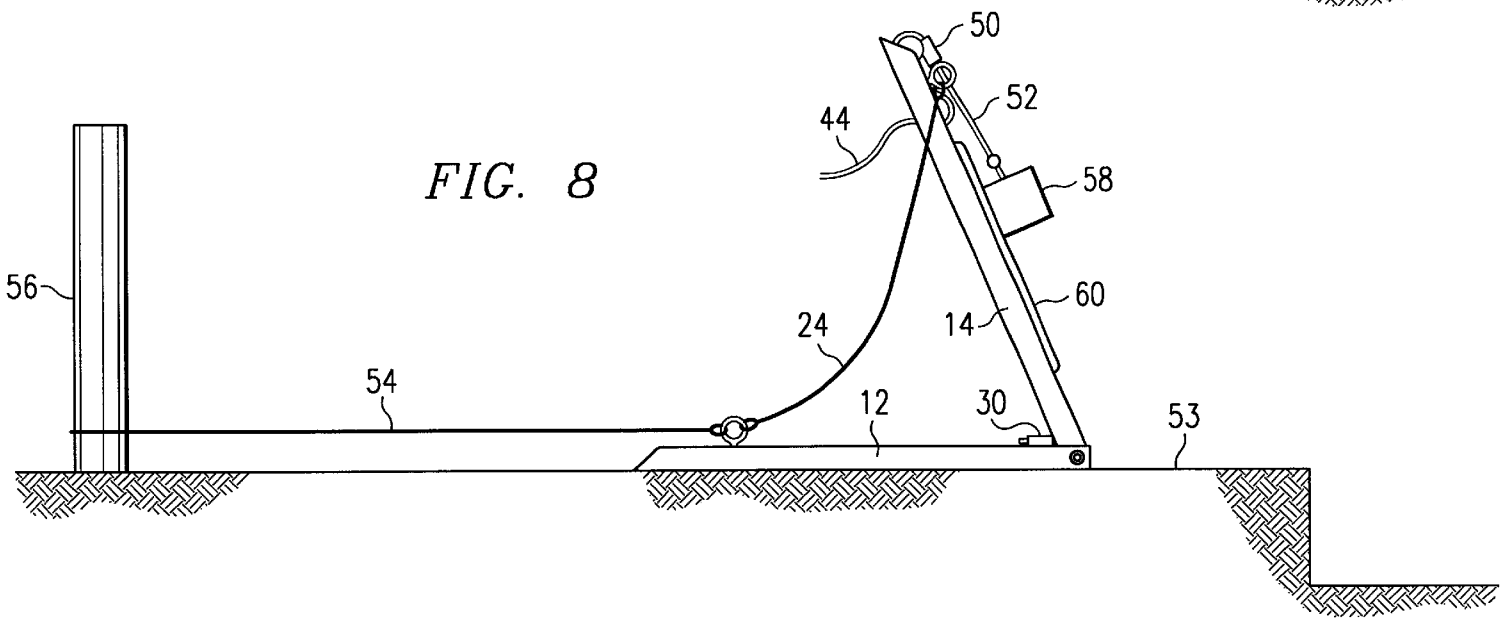
Figure 9:
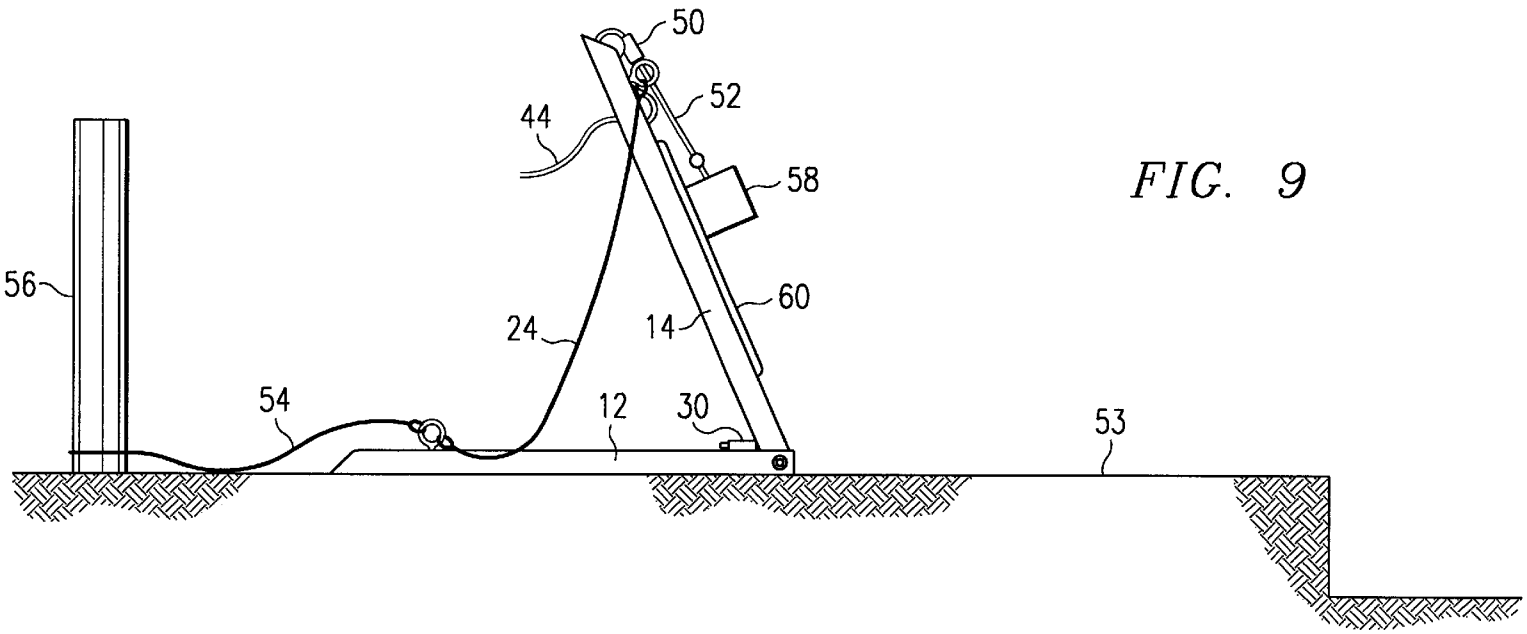

Once the load 58 is attached to the rope 44, the position of the rope 44 is changed so that it is engaged with the rope lock 38 (see FIG. 3). The load 58 can now be lifted by pulling on the rope 44 in a lifting direction until the stopper 50 contacts the pulley mechanism 32, as shown in FIG. 7. During lifting, the rope 44, which is engaged with the rope lock 38, can freely move in a lifting direction but cannot move in a lowering direction. Continuing to pull the rope 44 in the lifting direction will result in the boom 14 rotating about the pivot axis 18 with respect to the base 12 until the boom 14 comes into contact with the stop block 30, as shown in FIG. 8. The load 58 now rests on the bumper strips 60. In this configuration, the lift 10 does not require the operator to stand on the base 12 in order for the base 12 to be stabilized against the elevated surface 53, as the load 58 is now over the base 12 rather than being extended away from the base 12. The lift 10 can now be moved away from the edge of the elevated surface 53, as shown in FIG. 9, and the load 58 lowered to the elevated surface 53 by first changing the position of the rope 44 so that the rope 44 is not engaged with the rope lock 38 and then moving the rope 44 in the lowering direction until the load 58 rests on the elevated surface 53.

Figure 10:
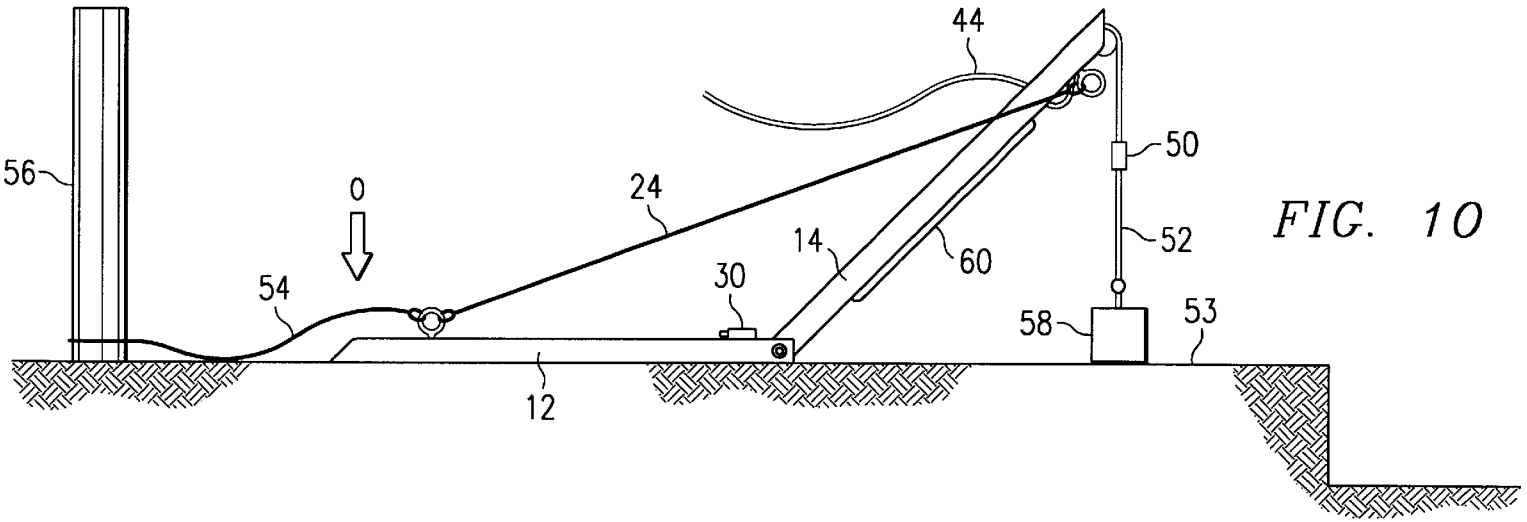

To lower the load 58 from the elevated surface 53, the steps described above are substantially followed in reverse. With the lift 10 away from the edge of the elevated surface and the load 38 is attached to the rope 44, as shown in FIG. 10. The rope 44 is positioned so that it is engaged with the rope lock 38. The load 58 is lifted by pulling the rope 44 in the lifting direction until the stopper 58 contacts the pulley mechanism 32. The rope 44 is pulled further in the lifting direction to cause the boom 14 to rotate about the pivot axis 18 with respect to the base 12 until the boom contacts the stop block 30, as shown in FIG. 9. The load 58 now rests on the bumper strips 60.

The lift 10 is then moved toward the edge of the elevated surface 53 until the safety ropes 54 are substantially taut, as shown in FIG. 8. The boom 14 is then rotated away from the operator, about the pivot axis 18, until the support cables 24 are substantially taut. The load 58 is now suspended out over the edge of the elevated surface 53, as shown in FIG. 7. The rope 44 is now positioned so that it is not engaged with the rope lock 38, and the load 58 is lowered by moving the rope 44 in the lowering direction until the load 58 rests at the position desired, as shown in FIG. 6.

Although the present invention has been described with referenced to a presently preferred embodiment, it will be appreciated by those skilled in the art that various modifications, alternatives, variations, etc., may be made without departing from the spirit and scope of the invention as defined in the appended claims.

What is claimed is:

1. An apparatus for moving a load, comprising:

a boom having a lower end and an upper end;

a base having a front end and a rear end, the front end of the base being pivotably connected to the lower end of the boom along a pivot axis, wherein a lower surface of the base rests on a support surface while a load is being moved;

a first restricting mechanism for restricting relative movement between the boom and the base about the pivot axis beyond a first position;

a second restricting mechanism for restricting the relative movement between the boom and the base about the pivot axis beyond a second position, the second position being different from the first position;

a pulley mechanism disposed proximal to the upper end of the boom; and a rope having a load end, the load end of the rope being for attaching to the load, the rope being threaded through the pulley mechanism;

wherein an attached load is lifted when the rope travels in a lifting direction through the pulley mechanism and the attached load is lowered when the rope moves in a lowering direction, which is opposite of the lifting direction, through the pulley mechanism, and wherein the boom is freely pivotable between the first position and the second position.

2. An apparatus for moving a load, according to claim 1, wherein:

the first restricting mechanism comprises at least one support cable connected between the boom and the base at locations which are distal from the pivot axis, the at least one support cable being for restricting relative movement between the boom and the base about the pivot axis beyond the first position when the at least one support cable is substantially taut, and the second restricting mechanism comprises a stop block removably attached to the upper surface of the base proximal to the pivot axis, the stop block being for restricting the relative movement between the boom and the base about the pivot axis beyond the second position when the boom is in contact with the stop block.

3. An apparatus for moving a load, according to claim 2, wherein the at least one support cable comprises a plurality of support cables.

4. An apparatus for moving a load, according to claim 1, wherein the relative movement between the boom and the base about the pivot axis is restricted to a range of about 30 degrees to about 180 degrees.

5. An apparatus for moving a load, according to claim 4, wherein the relative movement between the boom and the base about the pivot axis is restricted to a range of about 45 degrees to about 160 degrees.

6. An apparatus for moving a load, according to claim 1, wherein the base can be stabilized against the support surface by an operator standing on a portion of the base distal to the pivot axis.

7. An apparatus for moving a load comprising:

a boom having a lower end and an upper end;

a base having a front end and a rear end, the front end of the base being pivotably connected to the lower end of the boom along a pivot axis, wherein a lower surface of the base rests on a support surface while a load is being moved;

a first restricting mechanism for restricting relative movement between the boom and the base about the pivot axis in a first direction;

a second restricting mechanism for restricting the relative movement between the boom and the base about the pivot axis in a second direction;

a pulley mechanism disposed proximal to the upper end of the boom;

a rope having a load end, the load end of the rope being for attaching to the load, the rope being threaded through the pulley mechanism; and at least one bumper strip on a load-side of the boom for supporting the load as the boom is moved in the second direction with respect to the base about the pivot axis;

wherein an attached load is lifted when the rope travels in a lifting direction through the pulley mechanism and the attached load is lowered when the rope moves in a lowering direction, which is opposite of the lifting direction, through the pulley mechanism.

8. An apparatus for moving a load comprising:

a boom having a lower end and an upper end;

a base having a front end and a rear end, the front end of the base being pivotably connected to the lower end of the boom along a pivot axis, wherein a lower surface of the base rests on a support surface while a load is being moved;

a first restricting mechanism for restricting relative movement between the boom and the base about the pivot axis in a first direction;

a second restricting mechanism for restricting the relative movement between the boom and the base about the pivot axis in a second direction;

a pulley mechanism disposed proximal to the upper end of the boom;

a rope having a load end, the load end of the rope being for attaching to the load, the rope being threaded through the pulley mechanism;

a main pulley for guiding the rope;

a lock for selectively preventing the rope from being transmitted through the pulley mechanism, the lock being disposed proximal to and toward the lower end of the boom from the main pulley;

a roller for guiding the rope, the roller being disposed proximal to and toward the lower end of the boom from the lock; and a release pulley for guiding the rope, the release pulley being disposed proximal to and toward the lower end of the boom from the lock;

wherein an attached load is lifted when the rope travels in a lifting direction through the pulley mechanism and the attached load is lowered when the rope moves in a lowering direction, which is opposite of the lifting direction, through the pulley mechanism.

9. An apparatus for moving a load, according to claim 8, wherein the rope is threaded across a first side of the release pulley to cause the rope to engage the lock and the rope is threaded across a second side of the release pulley to cause the rope not to engage the lock.

10. An apparatus for moving a load, according to claim 8, wherein said second restricting mechanism comprises a stop block, wherein the rope has a stopper at a predetermined distance from the load end of the rope, wherein the stopper contacts a portion of the apparatus when the rope is advanced in the lifting direction through the pulley mechanism, and wherein, when the rope is pulled further in the lifting direction, the boom moves relative to the base about the pivot axis in the second direction if the boom is not in contact with the stop block.

11. An apparatus for moving a load, comprising:

a boom having a lower end and an upper end;

a base having a front end and a rear end, the front end of the base being pivotably connected to the lower end of the boom along a pivot axis, wherein a lower surface of the base rests on a support surface while the load is being moved;

a plurality of support cables connected between the boom and the base at locations which are distal from the pivot axis, the plurality of support cables being for restricting relative movement between the boom and the base about the pivot axis in a first direction when at least one of the plurality of support cables is substantially taut;

a stop block removably attached to the upper surface of the base proximal to the pivot axis, the stop block being for restricting the relative movement between the boom and the base about the pivot axis in a second direction when the boom contacts the stop block;

a pulley mechanism disposed proximal to the upper end of the boom; and a rope having a load end, the load end of the rope being for attaching to the load, the rope being threaded through the pulley mechanism, the rope having a stopper at a predetermined distance from the load end of the rope;

wherein the pulley mechanism comprises:

a main pulley for guiding the rope;

a lock for selectively preventing the rope from being transmitted through the pulley mechanism, the lock being disposed proximal to and toward the lower end of the boom from the main pulley;

a roller for guiding the rope, the roller being disposed proximal to and toward the lower end of the boom from the lock; and a release pulley for guiding the rope, the release pulley being disposed proximal to and toward the lower end of the boom from the lock, wherein the stopper contacts a portion of the apparatus when the rope is advanced in the lifting direction through the pulley mechanism and, when the rope is pulled further in the lifting direction, the boom moves relative to the base about the pivot axis in the second direction if the boom is not in contact with the stop block;

wherein an attached load is lifted when the rope travels in a lifting direction through the pulley mechanism and the attached load is lowered when the rope moves in a lowering direction, which is opposite of the lifting direction, through the pulley mechanism;

wherein the relative movement between the boom and the base about the pivot axis is restricted to a range of about 45 degrees to about 160 degrees;

wherein the base can be stabilized against the support surface by an operator standing on a portion of the upper surface of the base distal to the pivot axis; and wherein the rope is threaded across a first side of the release pulley to cause the rope to engage the lock and the rope is threaded across a second side of the release pulley to cause the rope not to engage the lock.

12. A method of moving a load with an apparatus, comprising the steps of:

stabilizing the apparatus with respect to a surface on which the apparatus rests;

attaching the load to a rope;

engaging the rope with a lock of the apparatus to prevent movement of the rope relative to the apparatus in a lowering direction;

applying a pulling force to the rope to lift the load in a lifting direction, which is opposite to the lowering direction; and pivoting a boom of the apparatus to move the load into contact with the apparatus.

13. A method of moving a load with an apparatus, according to claim 12, further comprising the steps of:

moving the apparatus across the surface on which the apparatus rests;

stabilizing the apparatus with respect to the surface on which the apparatus rests;

pivoting the boom of the apparatus so that the load is not in contact with the apparatus;

disengaging the rope from the lock of the apparatus while maintaining a tension on the rope to prevent the rope from moving uncontrollably in the lowering direction with respect to the apparatus;

allowing the rope to move relative to the apparatus in a controlled fashion in the lowering direction to lower the load; and detaching the load from the rope.

14. A method of moving a load with an apparatus, according to claim 12, wherein the step of applying a pulling force to the rope to lift the load in a lifting direction continues until a stopper of the rope comes into contact with the apparatus, and wherein the step of pivoting the boom of the apparatus comprises the step of applying a pulling force to the rope while the stopper is in contact with the apparatus.

* * * * *